US007547116B2

(12) United States Patent
Walker et al.

(10) Patent No.: US 7,547,116 B2
(45) Date of Patent: Jun. 16, 2009

(54) POSITIVE CONTRAST ROADWAY LIGHTING SYSTEM

(75) Inventors: Chris Walker, 12007 Sunrise Valley Dr., Suite 400, Reston, VA (US) 20191; Edward B. Bilson, Memphis, TN (US); Rick W. Kauffman, Buford, GA (US)

(73) Assignee: Chris Walker, Reston, VA (US)

( * ) Notice: Subject to any disclaimer, the term of this patent is extended or adjusted under 35 U.S.C. 154(b) by 0 days.

(21) Appl. No.: 11/891,144

(22) Filed: Aug. 9, 2007

(65) Prior Publication Data

US 2008/0037259 A1 Feb. 14, 2008

Related U.S. Application Data

(60) Provisional application No. 60/837,221, filed on Aug. 11, 2006.

(51) Int. Cl.
*F21S 6/00* (2006.01)

(52) U.S. Cl. ..... 362/257; 362/261; 362/291; 362/296; 362/431; 359/853; 359/869

(58) Field of Classification Search ..... 362/257, 362/295, 297, 341, 348, 350, 147, 261, 290, 362/296, 431; 359/853, 869
See application file for complete search history.

(56) References Cited

U.S. PATENT DOCUMENTS

| | | | | |
|---|---|---|---|---|
| 2,600,514 | A * | 6/1952 | Mitchell | 362/350 |
| 3,740,545 | A * | 6/1973 | Franklin et al. | 362/297 |
| 5,211,473 | A * | 5/1993 | Gordin et al. | 362/297 |
| 5,690,422 | A * | 11/1997 | Brass | 362/297 |
| 5,938,317 | A * | 8/1999 | Thornton | 362/290 |
| 6,419,378 | B1 | 7/2002 | Wedell et al. | 362/431 |

* cited by examiner

*Primary Examiner*—Sharon E Payne
*Assistant Examiner*—Mary Zettl
(74) *Attorney, Agent, or Firm*—Hoffmann & Baron, LLP

(57) ABSTRACT

A luminaire assembly generally includes a reflector having a center of symmetry and a lamp supported within the reflector, wherein the lamp is offset from the reflector center of symmetry, whereby light emitted from the lamp is reflected by the reflector in an asymmetric pattern. In a method of illuminating a roadway having traffic moving in a flow direction, a luminaire having a reflector and a lamp is mounted at a side of the roadway and light emitted from the lamp is reflected with the reflector whereby a greater portion of the reflected light is directed in the traffic flow direction than is directed against the traffic flow direction.

26 Claims, 12 Drawing Sheets

POSITIVE CONTRAST ROADWAY LIGHTING SYSTEM

CROSS-REFERENCE TO RELATED APPLICATIONS

This application claims the benefit of U.S. Provisional Application No. 60/837,221, filed on Aug. 11, 2006.

FIELD OF THE INVENTION

The present invention relates to luminaires for outdoor lighting and, more particularly, to a positive contrast roadway luminaire and lighting system.

BACKGROUND OF THE INVENTION

There are two groups that make recommendations and set standards for the lighting of roadways in the United States. These are the Illumination Engineering Society of North America (IESNA) in conjunction with the American National Standard Institute (ANSI), which publishes the American National Standard Practice for Roadway Lighting designated ANSI/IESNA RP-8-2000, and the American Association of State Highway and Transportation Officials (AASHTO), which publishes the "Roadway Lighting Design Guide". Moreover, the Federal Highway Administration (FHWA) has a manual for roadways, namely The Roadway Lighting Handbook 1978 (revised 1984), that includes lighting as do the fifty states which use it as the basis for their respective state practices. Some states use RP-8 and some use AASHTO, and some states have no written uniform policies, instead leaving lighting practice up to district offices. The FHWA has a policy of funding projects that use the AASHTO guide or ANSI/IESNA RP-8. The criteria for lighting freeways do not differ significantly between RP-8 and AASHTO for the Illuminance or Luminance Methods.

One of the major criteria recommended by both groups is the "full cutoff" requirement. This establishes limits on light emitted vertically from the luminaire to minimize "skyglow." Skyglow is the result of light directed upward into the atmosphere and is an undesired effect of outdoor lighting. It consists both of light from the luminaire that is reflected by the ground or other structures, as well as the direct light from the luminaire directed outward at near-horizontal angles and upward.

"Full cutoff," as defined by IESNA, requires that there be no direct light from the luminaire at or above the 90° vertical angle and no more than 10% of the lamp lumens at or above 80° vertical angle. This is interpreted by reviewing the candlepower distribution table of a photometric report of the luminaire and not finding any candlepower value in the angle ranges greater than 10% of the rated lamp lumens. For example, if a 400 watt HPS lamp is rated 50,000 lumens, then a candlepower value of 5000 or more at or above 80° vertical angle in any lateral plane would exceed the limit for this classification.

Conventional roadway lighting systems include roadway luminaires that provide a bisymmetric lighting distribution. This means that an equal amount of light is projected from the luminaire upstream and downstream of the traffic flow on the roadway. In other words, there is a light distribution symmetry about a plane perpendicular to the axis of the roadway. However, this light distribution results in glare and alternating areas of positive (in the direction of traffic) and negative (against the direction of traffic) light contrast.

Another standard practice is to space lighting poles at four to six (4-6), and more typically five (5), "mounting heights." As the term implies, "mounting height" is the height above ground at which the luminaire of the light pole is mounted. Thus, if the common mounting height is 40 feet above ground, the spacing between poles will typically be 160-240 feet. Typical mounting arrangements for roadway poles include single roadside arrangements, staggered double-sided arrangements, opposite double-sided arrangements and median mounted arrangements.

It is also important to light the right hand edge of the road to help the driver keep his vehicle on the road and to help identify exit and entrance ramps, as well as merging traffic. Slower traffic having mechanical problems typically travel to the right and animal and pedestrian intrusion also occurs in this area. For these reasons it is desirable for the luminaire to target light on the two most right hand lanes and the breakdown lane and let spill light take care of the inner lanes.

Other standard criteria for lighting roadways include minimum maintained average values for illuminance, luminance and Small Target Visibility (STV in RP-8). Each of these has a uniformity requirement as well as a requirement for comparing the average to the minimum and the maximum to the minimum. There also exists a glare measure called the veiling luminance ratio. This compares the cumulative contribution of the luminance of all of the luminaires to the background scene or pavement luminance.

Accordingly, it would be desirable to provide a roadway lighting system that meets as many of the illuminance, luminance, STV, uniformity, glare, full cutoff, spacing and utilization criteria as possible. It is also desirable to provide a system utilizing a "Positive Contrast" light distribution to improve visibility, complement vehicle headlights and minimize glare to the driver during the driving task, wherein the targeted veiling luminance ratio is 0.20:1.0 or less.

It would further be preferable to provide a luminaire having a size and shape that conforms to products that are currently on the market so as to blend in when used as a replacement in existing installations. The overall weight and EPA of the luminaire should be similar as well so as to not exceed ratings for existing poles and arms and to permit the retrofitting of luminaires with better performing, energy saving replacements.

SUMMARY OF THE INVENTION

The present invention is a luminaire assembly providing asymmetric, positive contrast lighting. The luminaire generally includes a reflector having a center of symmetry and a lamp supported within the reflector, wherein the lamp is offset from the reflector center of symmetry, whereby light emitted from the lamp is reflected by the reflector in an asymmetric pattern.

In a preferred embodiment, the reflector includes a plurality of curved reflective bands arranged coaxially in decreasing radial size order along a central z-axis beginning at a central x-y plane, wherein the central z-axis intersects the central x-y plane to define the center of symmetry. The curved bands can be circular to form a spherical reflector, elliptical to form an elliptical reflector or oval to form an ovoid reflector.

In the case of a spherical reflector, the reflector has a maximum diameter at the central x-y plane and a height along the central z-axis from the central x-y plane to a reflective top surface. The lamp is then preferably offset from the center of symmetry in an x-direction a distance of about one-third (⅓) the maximum diameter. The lamp is also preferably offset from the center of symmetry in a y-direction a distance of about one-twentieth (1/20) the maximum diameter and in a z-direction a distance of about one-eighth (1/8) the height.

In the case of an elliptical reflector, the reflector has a maximum minor axis dimension in an x-direction and a maximum major axis dimension in a y-direction at the central x-y plane and a height along the central z-axis from the central x-y plane to a reflective top surface. The lamp is then preferably offset from the center of symmetry in the x-direction a distance of about one-fourth (1/4) the maximum minor axis dimension. The lamp is also preferably offset from the center of symmetry in the y-direction a distance of about one-fifteenth (1/15) the maximum major axis dimension and in a z-direction a distance of about one-eighth (1/8) the height.

In the case of an ovoid reflector, the curved reflective bands preferably include four elliptically shaped arc segments defining an oval. The arc segments preferably include a first arc segment defined by a minor axis in the x-direction and a major axis in the y-direction and a second arc segment defined by a minor axis in the x-direction and a major axis in the y-direction, wherein the minor axes for the first and second arc segments are equal, and wherein the major axis for the first arc segment is greater than the major axis of the second arc segment. Also, the arc segments can be truncated in the x-direction so that said reflective band has a width less than the minor axes.

In all of the above described embodiments, the reflector can include a circumferential edge defining a reflector opening plane, wherein the reflector opening plane is disposed at an angle with respect to the central x-y plane. In addition, the luminaire can further include a planar lens plate disposed adjacent the reflector opening, wherein the planar lens plate is disposed at an angle with respect to the central x-y plane.

The present invention further involves a method for illuminating a roadway having traffic moving in a flow direction. The method generally includes the steps of mounting a luminaire having a reflector and a lamp at a side of the roadway and reflecting light emitted from the lamp with the reflector whereby a greater portion of the emitted light is directed in the traffic flow direction than is directed against the traffic flow direction.

In a preferred embodiment, the luminaire is mounted on a side of the roadway, and the method further includes the step of reflecting light emitted from the lamp with the reflector whereby a greater portion of the reflected light is directed in a direction away from a house side of the roadway than is directed toward the house side.

Also, the luminaire is preferably mounted above the roadway at a mounting height and the greater portion of the reflected light is directed in the traffic flow direction a distance equal to about four to five (4-5) times the mounting height and the portion of the reflected light directed in the opposite direction against the traffic flow direction is directed a distance equal to about one to two (1-2) mounting heights. Moreover, the greater portion of the reflected light is directed in the traffic flow direction at an angle of between sixty to seventy-six degrees (60°-76°) from vertical.

In another method for illuminating a roadway having traffic moving in a flow direction, a luminaire is mounted at an angle with respect to the roadway such that a greater portion of light emitted from the luminaire is directed in the traffic flow direction than is directed against the traffic flow direction. Light emitted from the luminaire is prevented from traveling against the traffic flow direction with a shield.

In another aspect of the present invention, an optical assembly for mounting in a luminaire is provided. The optical assembly generally includes a reflector having a center of symmetry and a lamp supported within the reflector, wherein the lamp is offset from the reflector center of symmetry in all axes, whereby light emitted from the lamp is reflected by the reflector in an asymmetric pattern.

In a preferred embodiment, the reflector includes an opening and the optical assembly further includes a reflector hood disposed at the reflector opening for directing light in the asymmetric pattern. The reflector hood restricts light emitted from the lamp at eighty degrees (80°) vertical and above on a direction of traffic side of the optical assembly and at fifty degrees (50°) vertical and above on an opposite side of the optical assembly.

The reflector hood preferably includes a ring portion and a bill portion extending from the ring portion. The ring portion has a size and shape adapted to fit on the opening of the reflector and the bill portion extends outwardly therefrom in a radial direction and is angled downward in the axial direction. The reflector hood can also be made adjustable with respect to the reflector for directing light in the desired asymmetric pattern.

A preferred form of the roadway luminaire and method for illumination, as well as other embodiments, objects, features and advantages of this invention, will be apparent from the following detailed description of illustrative embodiments thereof, which is to be read in conjunction with the accompanying drawings.

DETAILED DESCRIPTION OF THE PREFERRED EMBODIMENTS

Figure 1:
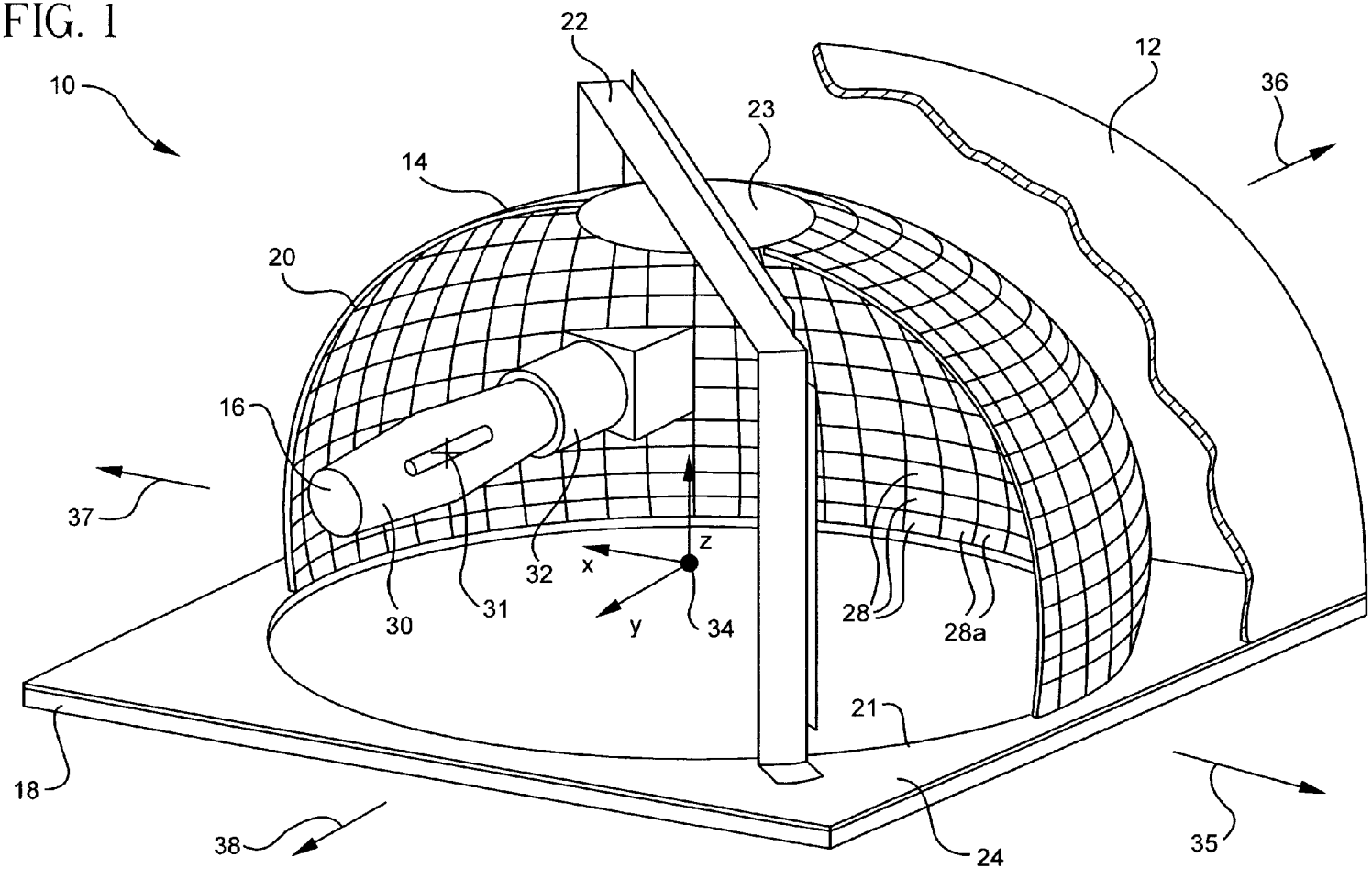
FIG. 1 is a top perspective partial-section view of the luminaire of the present invention.
Figure 2:
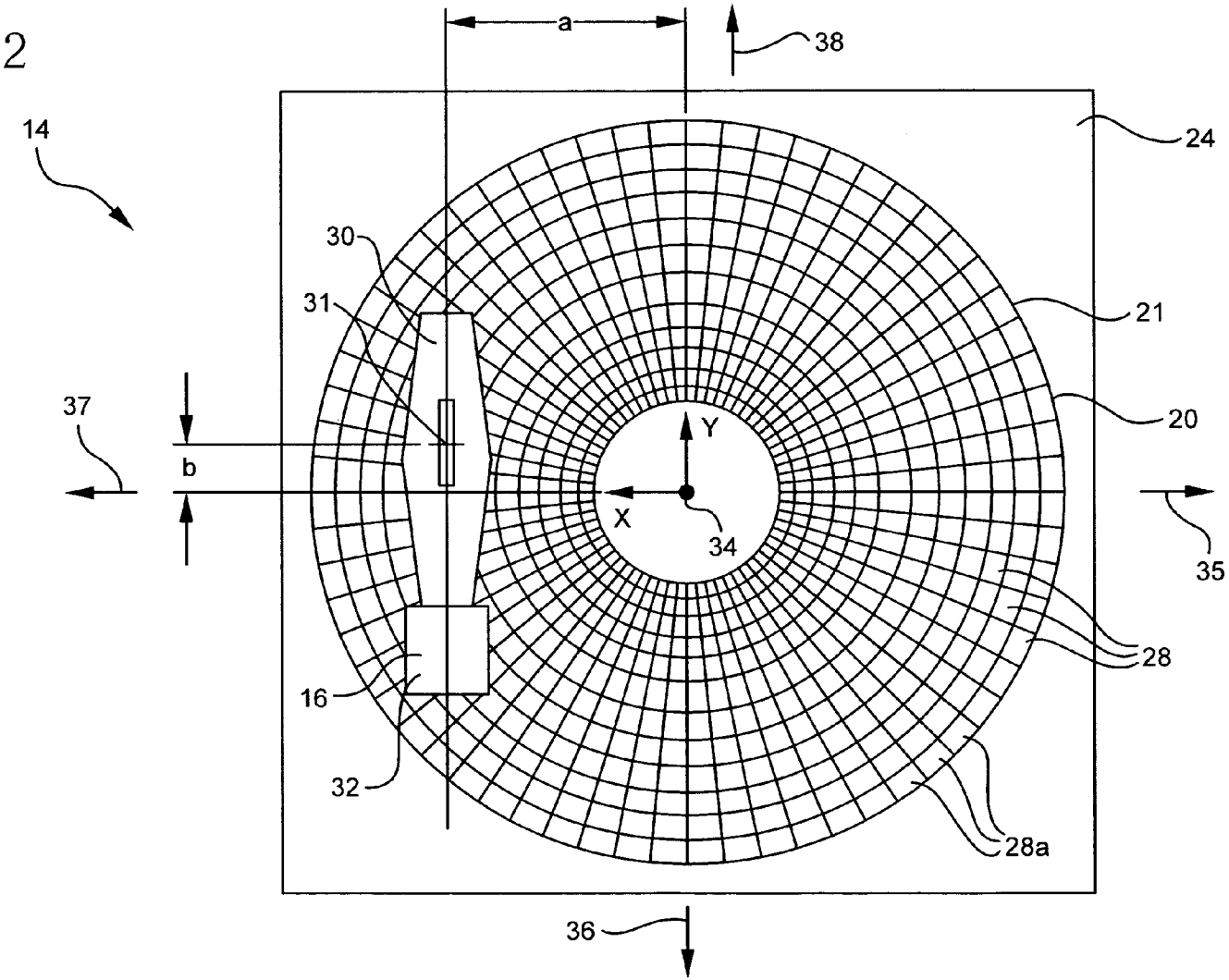
FIG. 2 is a bottom view of the luminaire shown in FIG. 1.
Figure 3:
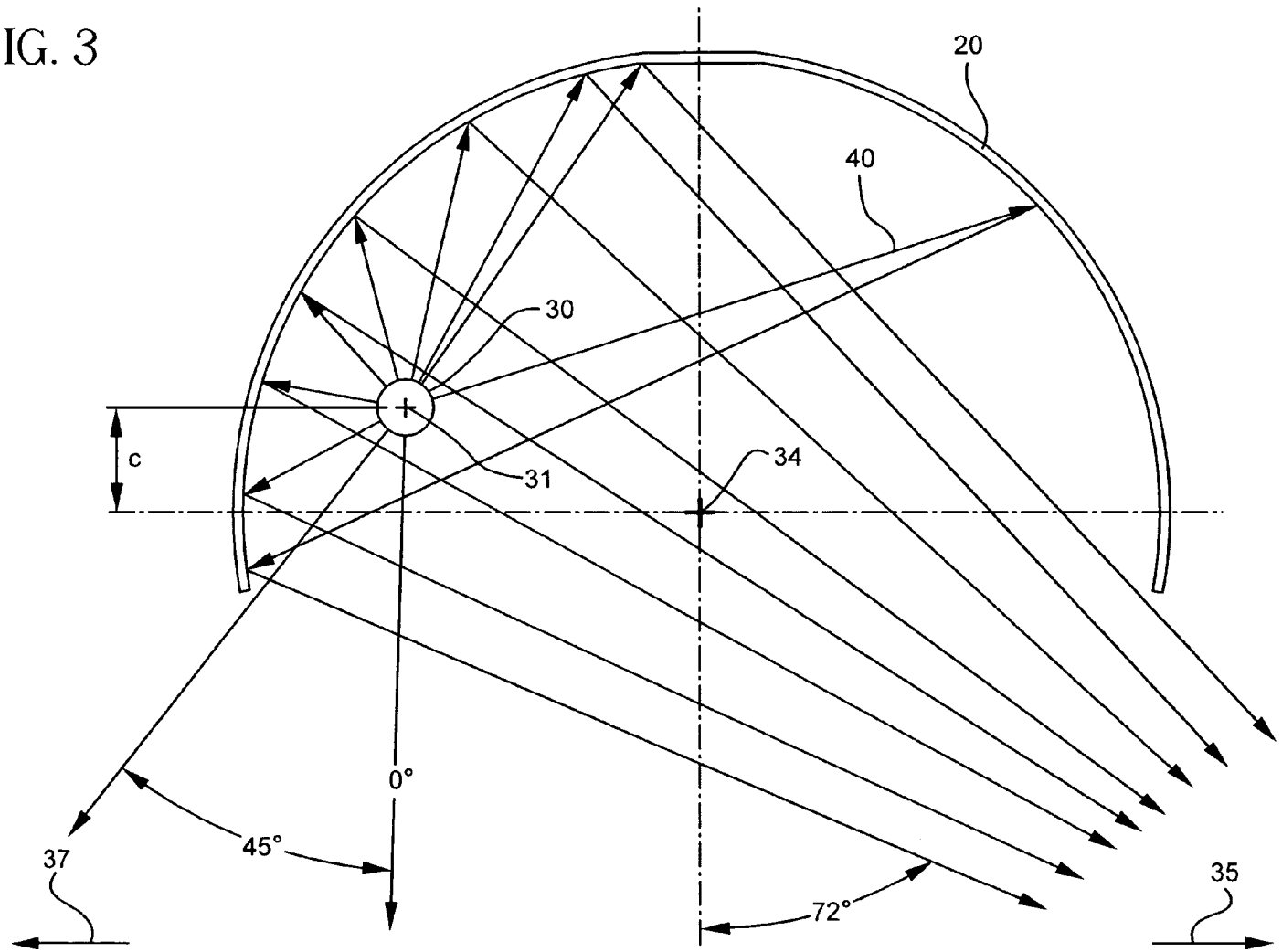
FIG. 3 is a schematic cross-sectional view of the reflector of the luminaire of FIG. 1 showing the light distribution.

Referring first to FIGS. 1-3, a luminaire 10 according to the present invention is shown. The luminaire 10 generally includes a luminaire housing 12, a reflector 14, a lamp assembly 16 and a lens plate 18.

The luminaire housing 12 can be of any shape or configuration and is adapted to mount to a light pole (not shown). The housing is preferably made from a die cast aluminum and has a minimum wall thickness of 0.093". In a preferred embodiment, the housing 12 has a "cobra-head" style since such is the most common style found in conventional roadway luminaires. In general, the light pole will be positioned offset from the side of a roadway, wherein light is distributed up the road in the direction of traffic 35, down the road in a direction against traffic 37, perpendicularly across the road in a "street side" direction 36 and back toward the pole in a "house side" direction 38.

The reflector 14 includes a radially symmetrical dome portion 20, a bracket portion 22 and a base portion 24. The dome portion 20 is preferably made from a pre-finished highly specularly reflective aluminum in a conventional manner. For example, a pre-finished specular aluminum sheet can be cut to a pattern, then formed and fastened together. Another method is to spin the profile using conventional metal spinning techniques and then polishing and finishing the interior surface to get the necessary performance. A third method is to mold the reflector surfaces and vacuum-metalize them with pure aluminum to provide the necessary performance.

The dome portion 20 is radially symmetrical and defines a circular opening 21 through which light emitted from the lamp assembly 16 exits. The dome portion 20 includes a plurality of horizontally arranged reflective bands 28 for directing the light out of the opening 21 in a desired direction. Beginning at the opening 21, the bands 28 forming the bottom-half portion of the dome 20 are preferably about one-half inch (0.5") in width. At about the mid-way point of the height of the dome 20, the bands 20 preferably increase in width to about one inch (1.0"). The bands terminate at a circular disk portion 23 disposed at the top of the dome portion.

Each band 28 may be in the form of a continuous circular band, or, more preferably, each band is segmented and consists of a plurality of rectangular shaped reflective facets 28*a* connected end-to-end to form a substantially circular band. Preferably, each band 28 consists of about sixty (60) rectangular segments or facets 28*a*. The rectangular facets 28*a* preferably have a length of about one inch (1.0") in the band 28 defining the opening 21 of the reflector 14 and gradually decrease in length in each successive band approaching the circular disk 23 at the top of the dome portion 20. It has been found that the rectangular segments or facets 28*a* send out individual beams of light that intersect each other creating better uniformity.

The rectangular facets 28*a* can define flat reflective surfaces or the reflective surfaces of the facets can be formed with a curve of non-constant radius. Thus, the midpoints of the bands can be connected with a curve of non-constant radius. This produces a smooth surface and reduces the possibility of manufacturing defects.

The bracket portion 22 is attached to both the top of the dome portion 20 and the base portion 24 to provide strength and stability to the reflector portion. The base portion 24 is generally a flat plate adapted to mount within the luminaire housing 12. The base portion 24 may further be provided with structure (not shown) for mounting the flat lens plate 18 thereto.

The lamp assembly 16 generally includes a lamp 30 and lamp socket 32. Electrical wiring (not shown) is connected to the lamp socket 32 in a conventional manner to provide power to the lamp 30. In a preferred embodiment, the lamp 30 is a 150-250 watt high pressure sodium (HPS) lamp. As will be discussed in further detail below, the present invention allows for the use of lower wattage lamps, as compared to the standard 310-400 watt lamps, although standard wattage lamps can be used in the present invention as well. The HPS lamp is preferred due to the geometry of its arc tube and its light emitting portion. The center 31 of the lamp 30 is defined as the mid-point of the arc tube along the longitudinal axis of the lamp.

The lens plate 18 is generally a flat glass plate, which can be mounted flush with the opening of the dome portion 20 of the reflector 14. Of course, other durable materials, as is known in the art, may also be used. Gaskets or other seals (not shown) are preferably provided between the lens plate 18 and the base portion 24 of the reflector 14 and/or the luminaire housing 12 to prevent moisture or other contaminants from entering the dome portion 20 of the reflector.

Figure 4:
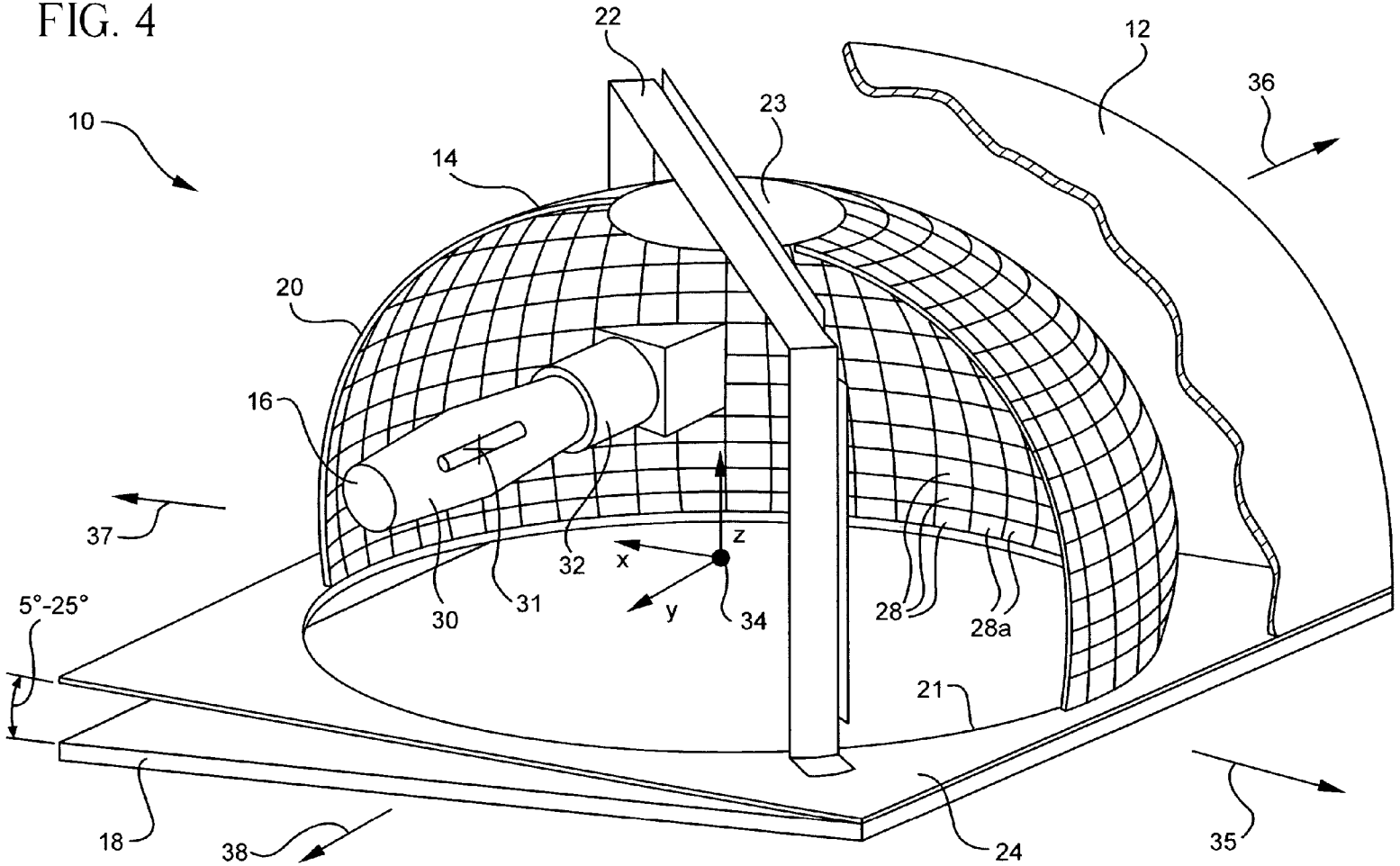
FIG. 4 is a top perspective partial-section view of the luminaire with the lens plate tilted according to a preferred embodiment of the present invention.

In a preferred embodiment, the lens plate 18 is mounted to the reflector 14 at an angle with respect to the opening of the dome portion 20, as shown in FIG. 4. As will be discussed in further detail below, positioning the lens plate 18 at an angle with respect to the opening of the dome portion 20 reduces the angle of incidence of the light rays leaving the reflector and passing through the lens plate. This will result in more light exiting the luminaire and less light being reflected by the lens plate 18 back into the dome portion 20. The angle of tilting of the lens plate 18 with respect to the bottom opening of the dome portion 20 is preferably between five and twenty five degrees (5°-25°) with the edge of the lens plate intersecting with the plane defining the bottom opening of the dome portion on the direction of traffic side 35 of the reflector 14 and the apex of the angle formed by the lens plate falling on the direction against traffic side 37 of the reflector.

Part of the present invention lies in the positioning of the lamp assembly 16 within the reflector 14. Unlike conventional luminaires, the lamp assembly 16 of the present invention is offset from the center of the reflector 14. Based on an X,Y,Z Cartesian coordinate system oriented at the radial center 34 of the dome portion 20, wherein the x-axis is parallel to the roadway, the y-axis runs perpendicularly across the roadway and the z-axis extends vertically away from the roadway, the lamp assembly 16 is offset a pre-determined distance in all three directions. Specifically, the center 31 of the lamp 30 is offset a distance "a" from the dome center 34 along the x-axis in a direction against the flow of traffic 35 on the roadway, along the y-axis a distance "b" in a direction toward the "house side" 36 of the luminaire and along the z-axis a distance "c" in a direction upward into the dome portion 20. As will be discussed further below, this positioning of the lamp assembly 16 within the reflector 20 results in a greater proportion of light being directed up the roadway in the direction of traffic (i.e., positive contrast lighting), as well as a greater proportion of light being directed in the "street side" 36 direction across the roadway, and less on the "house side" 38.

It has been found that best photometric results are achieved by shifting the center 31 of the lamp 30 in the x-direction a distance of about one third (⅓) the maximum diameter of the dome portion 20 and in the y-direction a distance of about one twentieth (1/20) the maximum diameter of the dome portion. The center 31 of the lamp 30 is also preferably positioned above the center 31 in the z-direction at a distance of about one eighth (⅛) the distance from the center to the top of the dome.

Using specific dimensions, it has been found that a dome portion 20 having a diameter of about twenty inches (20.0"), a height of about eight inches (8.0") above the center 34 and a disk portion 23 having a diameter of about five inches (5.0") produces the best photometric results. This means that the lamp assembly 16 will be offset from center 34 in the x-direction about 6.5" and in the y-direction about 1.0". Also, the lamp 16 is then spaced a distance of about 1.0" above the center 34 in the z-direction.

As shown in FIGS. 1-5, the edge of the dome portion 20 defining the reflector opening 21 can extend below the design center 34 to provide even further focusing of the reflected light. In a preferred embodiment, the edge defining the reflector opening 21 extends a distance of about one third (⅓) the distance from the center 34 to the top of the dome. Again, using specific dimensions, if the dome portion 20 has a height of about eight inches (8.0") above the center 34, the plane defined by the reflector opening 21 will be disposed about two and one-half inches (2-½") below the design center 34 to produce the best photometric results.

With the lamp assembly 16 thus positioned, the reflective bands 28 are designed to reflect light emitted from the lamp at an optimum angle down the road in the direction of traffic 35 to provide the maximum contrast lighting benefit. It has been found that the optimum angle for directing light up the roadway is between sixty and seventy-six degrees (60°-76°), and more preferably between about seventy-two degrees and seventy-six degrees (72°-76°), as shown in FIG. 3.

This lamp positioning also allows a portion of the light emitted from the lamp assembly 16 to be directed at optimum angles up the road in the opposite direction 37 against traffic. It has been found that the optimum angle for this "upstream" light is between zero and about fifty degrees (0°-50°). Light emitted at a higher angle against the flow of traffic is more likely to shine directly in the eyes of drivers and create a safety hazard.

Finally, by positioning the lamp assembly 16 as described, light rays 40 emitted from the lamp 30 that strike the opposite far half of the reflector dome portion 20 are reflected back and impinge on the near half of the reflector dome portion and are, in turn, directed "downstream" 35 in the direction of traffic at the optimum angle of between about 72°-76°. Thus, most of the light emitted from the lamp assembly 16 is directed downstream to provide maximum positive contrast lighting.

Figure 5:
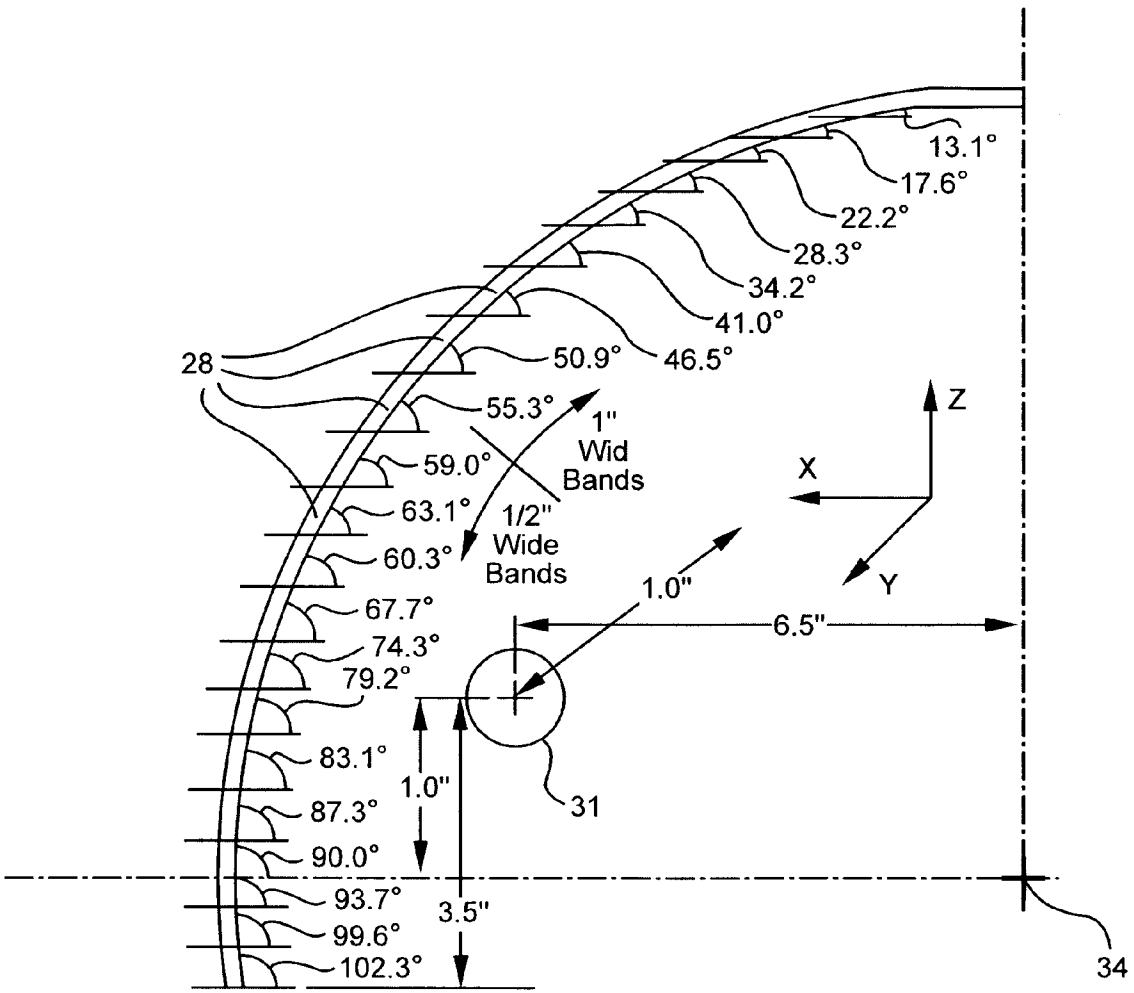
FIG. 5 is a cross-sectional view of one half of the reflector showing the aiming angle of each reflective band.

To achieve the optimum "downstream" angle, each reflective band 28 is individually angularly oriented to reflect light hitting the respective band at the optimum angle. FIG. 5 schematically shows the aiming angle of each reflective band with respect to the horizontal plane defined by the x and y axes.

The luminaire 10 thus far described and shown in FIGS. 1-5 is particularly suitable with new construction and installation of roadway lighting. However, it is also desirable to provide an optical module of suitable construction for replacing existing reflector assemblies in the field that are smaller in size. To accomplish this, the above described apparatus can be modified by changing the shape of the reflector to reduce its overall size.

Figure 6:
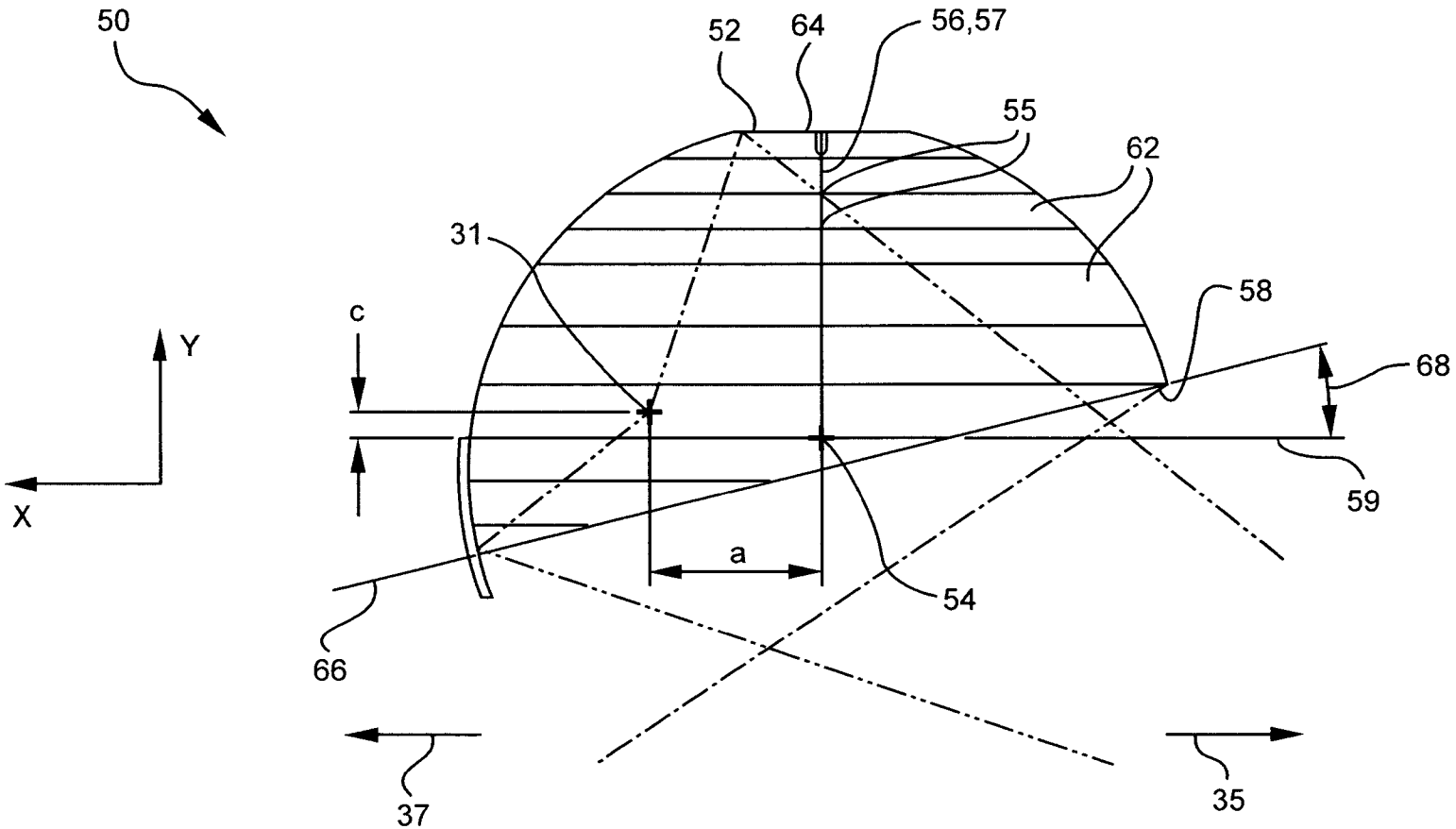
FIG. 6 is cross-sectional view of an alternative embodiment of the reflector of the present invention showing light distribution.
Figure 7:
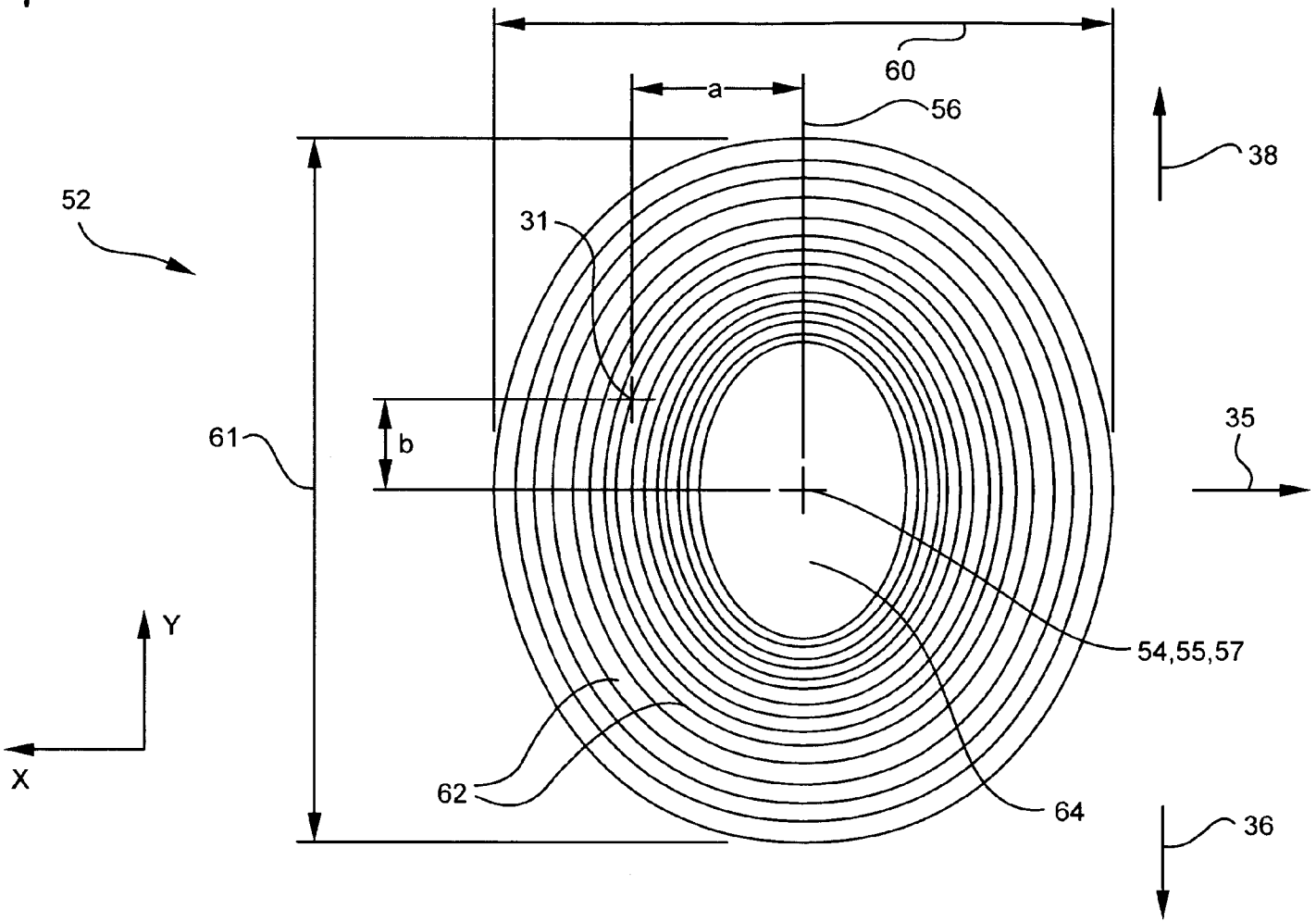
FIG. 7 is a bottom view of the reflector shown in FIG. 6.

Turning now to FIGS. 6-10, in an alternative embodiment of the present invention, the luminaire 50 includes an elliptically shaped reflector 52 having a design center 54 and a plane of symmetry 56 in the y-z plane. The elliptically shaped reflector 52 can be defined by a series of reflective bands 62 that are in the shape of true ellipses and are stacked in decreasing size order in the upward vertical direction (i.e., z-axis direction) away from the downward facing elliptical opening 58 of the reflector, as shown in FIG. 7.

Figure 8:
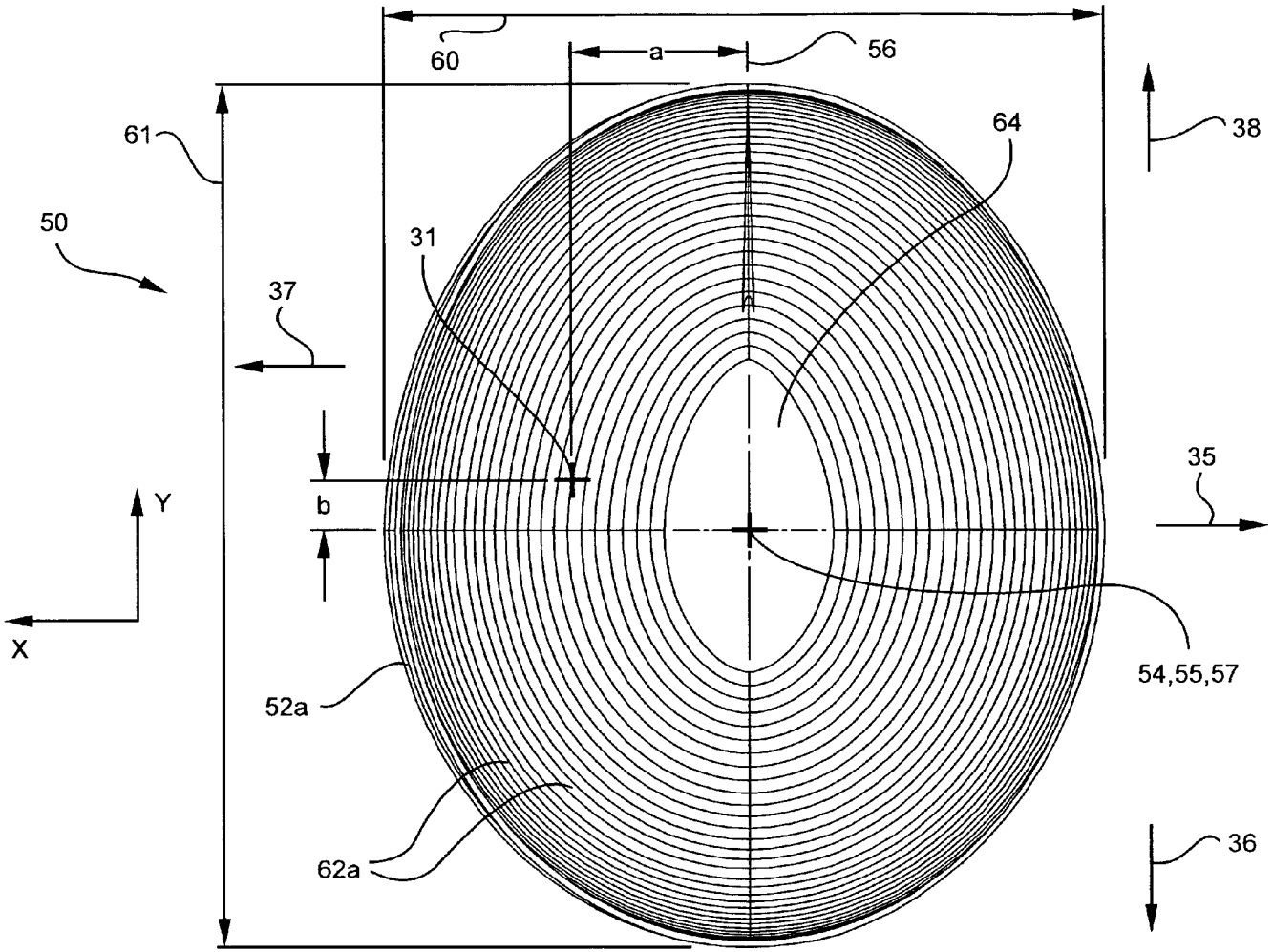
FIG. 8 is a bottom view of the reflector shown in FIG. 6 with a slightly different shape.

Alternatively, to reduce the size of the reflector further while maintaining improved light reflection, a reflector 52*a* can be made having an egg, ovate or ovoid shape from a series of reflective bands 62*a* that are not true ellipses, as shown in FIG. 8. Instead, as will be discussed in further detail below, the reflective bands 62*a* of the ovoid reflector 52*a* are oval in shape and are symmetric about a plane of bi-symmetry 56, as opposed to an axis of symmetry to reduce the overall size of the reflector. The phrase "plane of bi-symmetry" means the right half of the reflector is a mirror image of the left half.

In the case of the true elliptical reflector 52 shown in FIG. 7, each elliptical reflective band 62 is defined by a minor axis in the x-direction, a major axis in the y-direction and a center 55 (i.e., the point halfway between the foci of each ellipse). The ellipses are coaxially arranged such that the centers 55 of each ellipse align to form a central axis 57. The largest of the stacked ellipses defines a horizontal plane 59, which generally coincides with the reflector opening 58. The design center 54 of the reflector 52 is defined as the point where the central axis 57 intersects the horizontal plane 59 of the largest ellipse.

Like the spherical reflector 20 described above, the elliptical reflector 52 includes a plurality of horizontally arranged reflective bands 62, for directing the light out of the opening 58 in a desired direction, which terminate at an elliptical reflective surface 64 disposed at the top of the reflector. Again, each band 62 may be in the form of a continuous elliptical band, or, more preferably, each band is segmented and consists of a plurality of rectangular shaped reflective facets connected end-to-end to form a substantially elliptical band, as described above. However, with the smaller elliptical reflector 52, since the reflective surfaces are closer to the lamp center 31, it is necessary to reduce the band width to 0.25 inches in order to sufficiently control the light distribution. FIG. 6 shows the revised aiming angles of the bands and the elliptical footprint utilized to shrink the design.

Figure 8A:
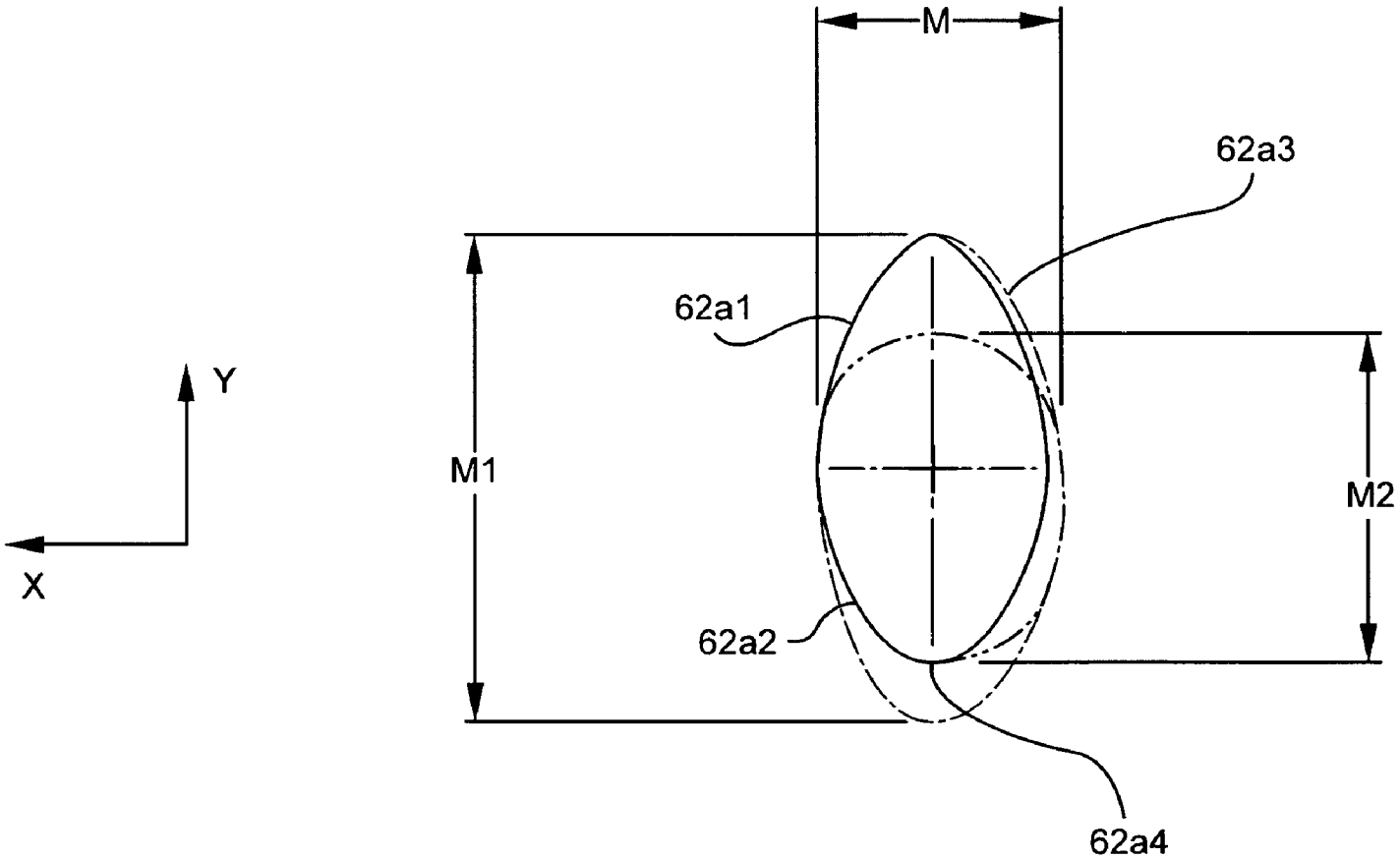
FIG. 8A is a partial view of one of the oval reflective bands shown in FIG. 8.

In the case of the ovoid shaped reflector 52*a* shown in FIGS. 8 and 8A, each oval shaped reflective band 62*a* is made from four elliptically shaped arc segments 62*a*1, 62*a*2, 62*a*3 and 62*a*4. In particular, the arc segments 62*a*1 shown in the upper left-hand quadrant of the reflector in FIG. 8A are defined by a minor axis m in the x-direction and a major axis M1 in the y-direction. The arc segments 62*a*1 shown in the lower left-hand quadrant are also defined by a minor axis m in the x-direction and a major axis M2 in the y-direction. While the minor axes m for the arc segments 62*a*1 and 62*a*2 in both the upper and lower quadrants segments are the same, the major axes Ml for the arc segments of the upper quadrant 62*a*1 is greater than the major axes M2 of the arc segments 62*a*2 of the lower quadrant. Moreover, to reduce the size of the reflector further, the reflective bands 62*a* can be truncated in the direction of the minor axes (x-direction), as shown in FIG. 8A, so that each reflective band 62*a* has a width less than the minor axis of each segment. With the left side of the reflector being a mirror image of the right side, with respect to the plane of symmetry 56, this results in a series of reflective bands that are oval in shape.

Also like the spherical reflector 20 described above, both the elliptical reflector 52 and the ovoid reflector 52*a* are designed to be positioned offset from the side of a roadway, wherein light is distributed up the road in the direction of traffic 35, down the road in a direction against traffic 37, perpendicularly across the road in a "street side" direction 36 and back toward the pole in a "house side" direction 38. In this case, the minor axes 60 of the elliptical and ovoid reflectors 52 extend parallel with the road and the major axes 61 extend generally perpendicular to the road direction.

Again, the center 31 of the lamp (not shown in FIGS. 6-10) is positioned offset from the design center 54 of the reflector 52, 52*a*. As described above, based on an X,Y,Z Cartesian coordinate system oriented at the center 54 of the elliptical reflector 52 and the ovoid reflector 52*a*, wherein the x-axis is parallel to the roadway, the y-axis runs perpendicularly across the roadway and the z-axis extends in the positive direction vertically away from the roadway, the lamp center 31 is offset a pre-determined distance in all three directions. Specifically, the center 31 of the lamp is offset a distance "a" from the center 54 along the x-axis in a direction against the flow of traffic 35 on the roadway, along the y-axis a distance "b" in a direction toward the "house side" 36 of the luminaire and along the z-axis a distance "c" in a direction upward into the reflector 52, 52*a*. As discussed above, this positioning of the lamp assembly within the reflector 52, 52*a* results in a greater proportion of light being directed up the roadway in the direction of traffic 35 (i.e., positive contrast lighting), as well as a greater proportion of light being directed in the "street side" 36 direction across the roadway, and less on the "house side" 38.

With the elliptical reflector 52, it has been found that best photometric results are achieved by shifting the center 31 of the lamp in the x-direction a distance of about one fourth (¼) the length of the minor axis of the largest ellipse adjacent the opening 58 and in the y-direction a distance of about one fifteenth (1/15) the length of the major axis of the largest ellipse adjacent the opening. The center 31 of the lamp is also preferably positioned above the center 54 in the z-direction at a distance of about one eighth (⅛) the distance from the center to the top of the reflector.

Using specific dimensions, it has been found that an elliptical reflector 52 having a maximum major axis of about fifteen inches (15.0"), a maximum minor axis of about twelve inches (12.0") and a height above the design center 54 of about six inches (6.0") produces the best photometric results. This means that the center 31 of the lamp assembly will be offset from the reflector center 54 in the x-direction about 3.0" (a dimension) and in the y-direction about 1.0" (b dimension). Also, the lamp center 31 is then spaced a distance of about ¾" (c dimension) above the reflector center 54 in the z-direction.

With the lamp center 31 thus positioned, the reflective bands 62 are designed to reflect light emitted from the lamp at an optimum angle down the road in the direction of traffic 35 to provide the maximum positive contrast lighting benefit. This lamp positioning also allows a portion of the light emitted from the lamp assembly to be directed at optimum angles up the road in the opposite direction 37 against traffic. As described above, the optimum angle for directing "downstream" light up the roadway in the direction 35 is between about seventy-two degrees and seventy-six degrees (72°-76°), and the optimum angle for directing "upstream" lights up the road in the opposite direction 37 against traffic is between zero and about fifty degrees (0°-50°).

Figure 10:
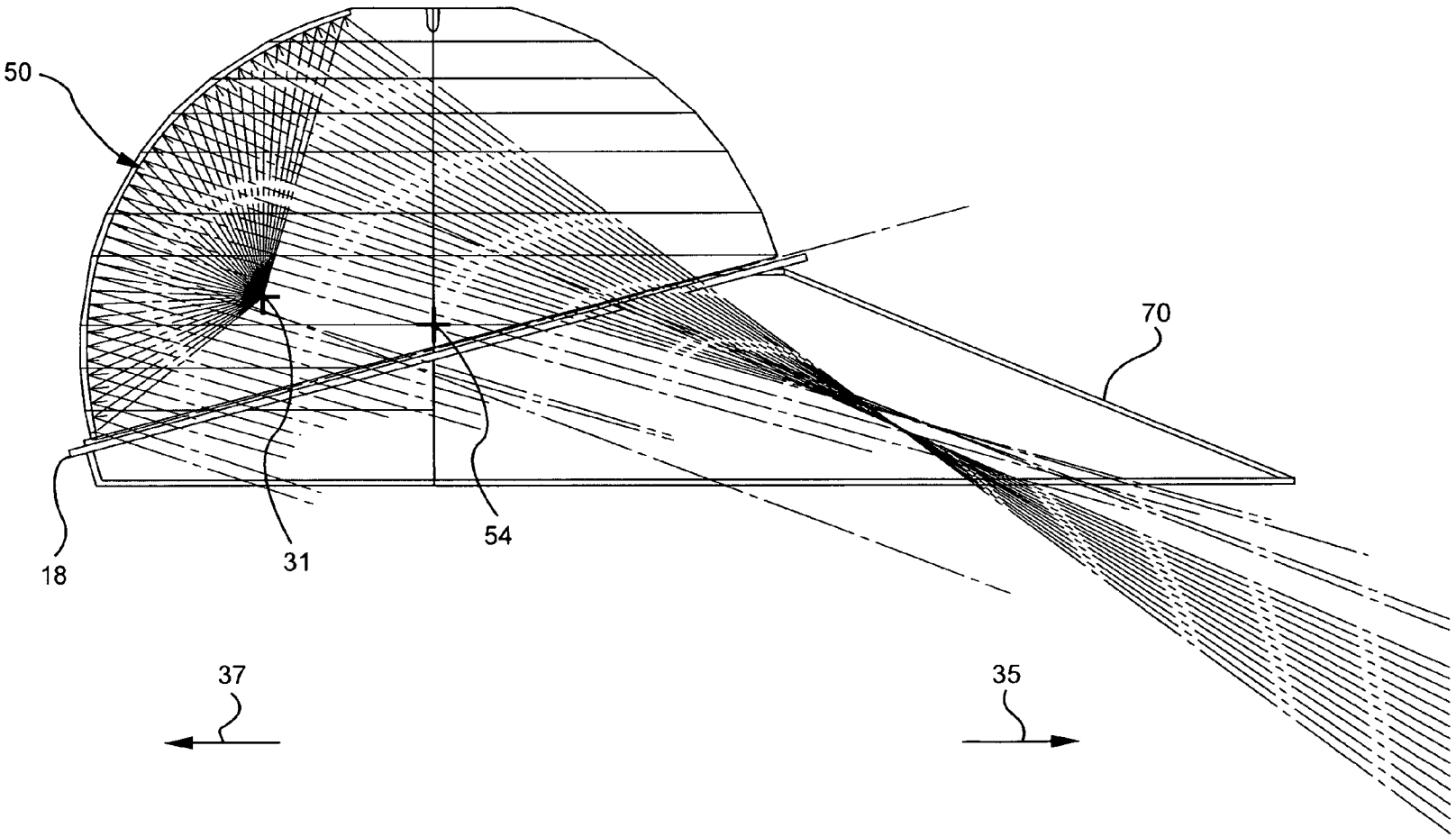
FIG. 10 is a cross-sectional view of the reflector/shield assembly shown in FIG. 8.
Figure 11:
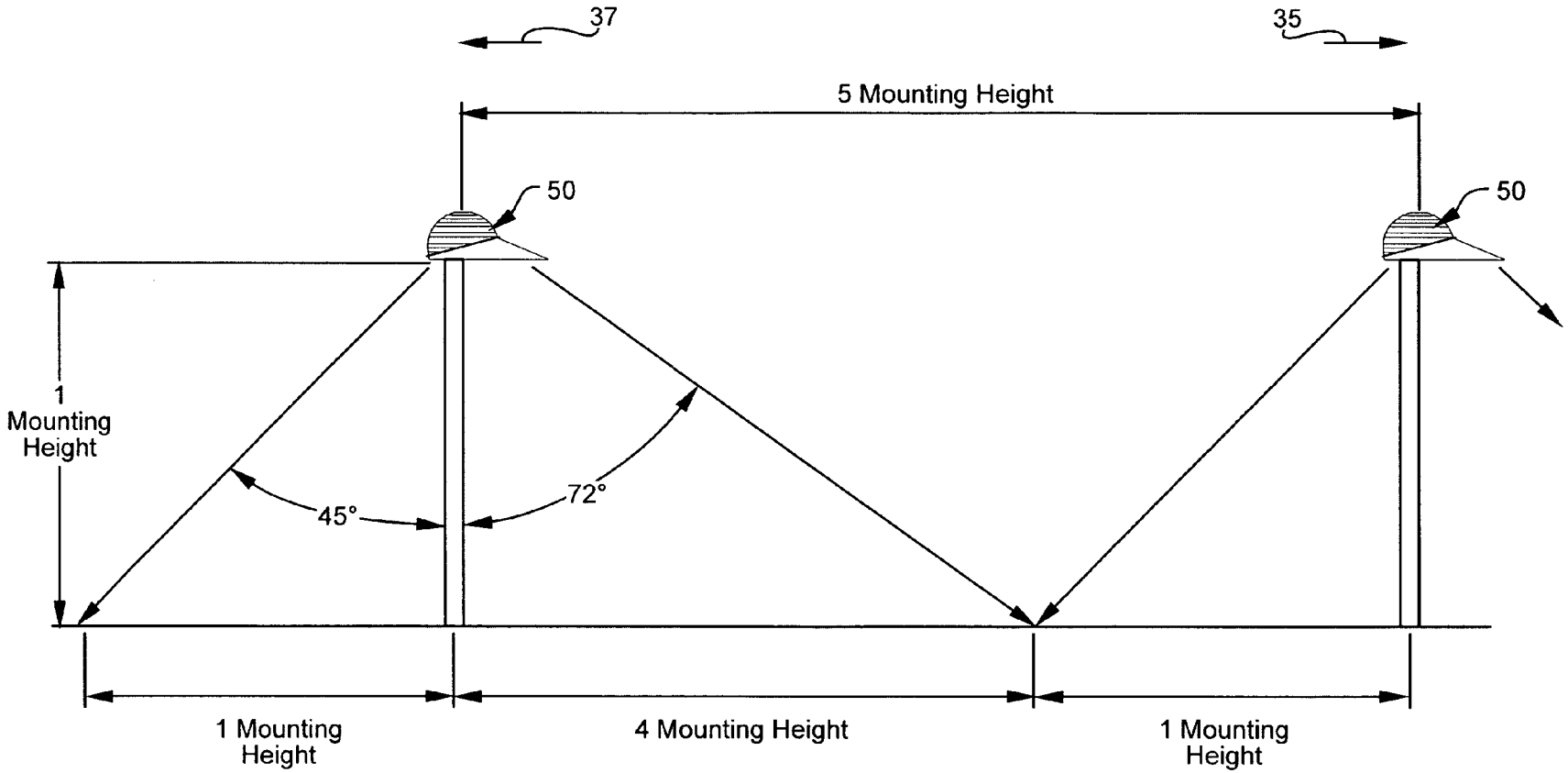
FIG. 11 is a diagrammatic view of two luminaires of the present invention positioned along a roadway.

The profile from the light source to the reflector 52 and then from the reflector to the roadway is illustrated by the ray tracings shown in FIGS. 6 and 10. The profile is promulgated along an elliptical path from the center axis to the vertical axis on the house side. The counter side is then mirrored to the pro side completing the reflector 50.

FIG. 6 also shows a reflector opening 58 which is slightly modified as compared to the opening described above with respect to the spherical reflector. Specifically, the edge 65 surrounding the opening 58 of the reflector 50 shown in FIG. 6 defines a plane 66 that is not parallel with the plane 59 defined by the largest elliptical band. Instead, the plane 66 defined by the opening 58 is disposed at an angle 68 with respect to the plane 59 defined by the largest elliptical band. This angle 68 is preferably between about five and twenty five degrees (5°-25°), and is more preferably about fifteen degrees (15°). The angle 68 is preferably made by extending the edge 65 on the traffic facing side 37 of the reflector 50 slightly below the plane 59 defined by the largest elliptical band and terminating the edge on the traffic flow side 35 of the reflector slightly above the plane defined by the largest elliptical band. This will allow a greater portion of the light to travel in the positive traffic flow direction 35 and prevent a greater portion of the light to travel in the negative traffic facing direction 37.

Figure 9:
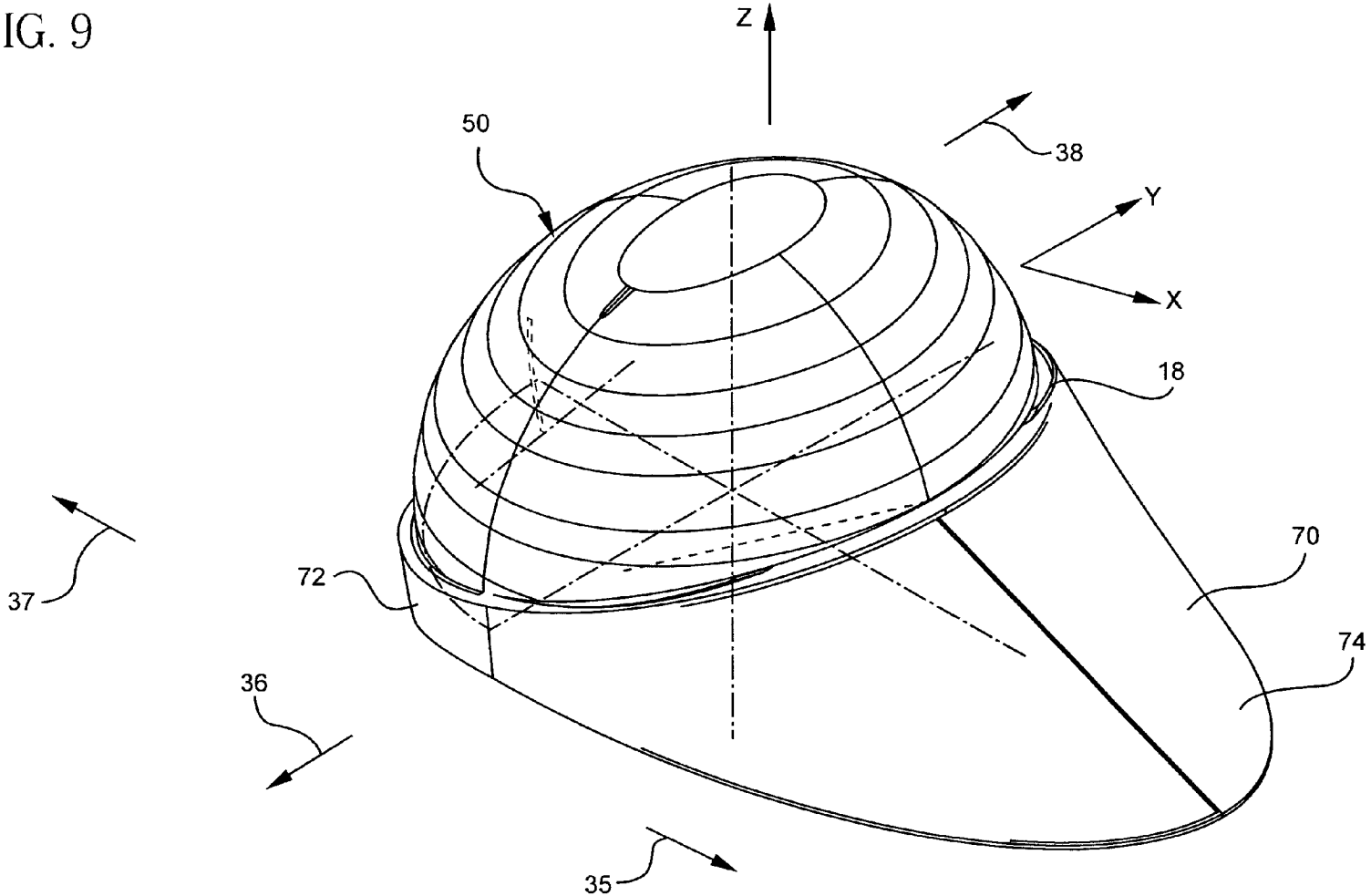
FIG. 9 is a top perspective view of the reflector shown in FIGS. 6-8 having attached thereto a reflector shield according to the present invention.

As can be appreciated, with the opening 58 thus angled, the lens plate 18 can be disposed directly against the edge of the reflector 50, as shown in FIGS. 9 and 10. As discussed above, positioning the lens plate 18 at an angle reduces the angle of incidence of the light rays leaving the reflector and passing through the lens plate. This will result in more light exiting the luminaire and less light being reflected by the lens plate 18 back into the reflector 50.

With the reflector opening 58 tilted an angle to allow light out at higher vertical angles on the pro side, the reflector 50 further preferably includes a reflector hood 70, as shown in FIGS. 9 and 10, to restrict the amount of light at eighty degrees (80°) vertical and above on the pro side (direction of traffic 35). The hood 70 is also configured to restrict light above fifty degrees (50°) vertical in the counter direction (direction against traffic 37).

In this regard, the hood 70 resembles a visor having a ring portion 72 and a bill portion 74 extending from the ring portion. The ring portion 72 has a size and shape adapted to fit on the opening edge 65 of the reflector 50 and the bill portion 74 extends outwardly therefrom in a generally radial direction and is also angled slightly downward in the axial direction. When attached to the reflector 50, the bill portion 74 extends in the traffic flow direction 35 and is angled downward from the horizontal plane 59 at about a seventy-two to seventy-six degree (72°-76°) angle so as to prevent any light at an angle above about eighty degrees (80°) from exiting the reflector. Similarly, the ring portion 72 prevents any light above fifty degrees (50°) vertical from exiting the reflector. The hood 70 can be made from any durable material adapted for external environments and can be attached to the reflector 50 in any conventional manner.

Whereas it may be desirable to rotate the luminaire 10 about its axis or the optical assembly 12 or 50 within the luminaire about its axis to distribute more light in the direction of flow of traffic 35 and less light counter to traffic flow 37, or vice-versa, a means of adjusting the luminaire 10 or optical assembly 12 or 50 can be provided. Moreover, the visor 70 can also be provided with a means of adjustment to adjust the visor with respect to the reflector in order to shield any undesired upward light (i.e., light above eighty degrees (80°) vertical in the traffic flow direction and light above fifty degrees (50°) vertical in the direction against traffic). In this regard, the visor 70 can be made adjustable with respect to the reflector as a whole, or the ring portion 72 may be adjusted independently of the bill portion 74. This can be accomplished by providing, for example, a thumb screw and a protractor attached at the centerpoint between the ring and bill of the shield. The thumb screw would be loosened and the shield adjusted to a vertical angle using the protractor attached under the screw. The vertical angles could be provided in a table in a user's guide furnished with the system.

With any of the spherical reflector 20, the elliptical reflector 52, or the ovoid reflector 52*a*, the luminaire of the present invention provides an asymmetric, positive contrast light distribution providing improved visibility with virtually no glare. This is also achieved while maintaining a five mounting height (5 MH) distance between adjacent luminaires 10, as shown in FIG. 10. In particular, the luminaire 10 of the present invention provides 4 MH of positive contrast lighting and 1 MH of negative contrast lighting so that the luminaires can be spaced at a distance of 5 MH.

Tables 1 and 2 below set forth the performance characteristics of the positive contrast lighting system (PCLS) of the present invention as compared to several selected conventional roadway lighting systems using a 250 W HPS lamp and a 150 W HPS lamp.

TABLE 1

PCLS vs. the "Cobrahead" for Freeway A - 250 W HPS

| System | $E_{avg}$ | $E_{avg/min}$ | $L_{avg}$ | $L_{avg/min}$ | $L_{max/min}$ | $Lv_{max}/Lp_{avg}$ | STV |
|---|---|---|---|---|---|---|---|
| Cobra 1 | 0.94 | 2.39 | 0.68 | 1.77 | 2.82 | 0.22 | 2.98 |
| Cobra 2 | 0.90 | 2.40 | 0.66 | 2.15 | 3.78 | 0.19 | 2.90 |
| Cobra 3 | 1.05 | 2.21 | 0.86 | 2.27 | 4.80 | 0.25 | 2.73 |
| PCLS 1 | 1.42 | 3.11 | 0.83 | 1.96 | 3.33 | 0.10 | 6.33 |

TABLE 2

PCLS vs. the "Cobrahead" for Freeway A - 150 W HPS

| System | $E_{avg}$ | $E_{avg/min}$ | $L_{avg}$ | $L_{avg/min}$ | $L_{max/min}$ | $Lv_{max}/Lp_{avg}$ | STV |
|---|---|---|---|---|---|---|---|
| Cobra 1 | 0.53 | 2.39 | 0.39 | 1.77 | 2.82 | 0.22 | 2.42 |
| Cobra 2 | 0.51 | 2.40 | 0.38 | 2.15 | 3.78 | 0.19 | 2.34 |
| Cobra 3 | 0.60 | 2.21 | 0.49 | 2.27 | 4.80 | 0.25 | 2.22 |
| PCLS 1 | 0.93 | 3.11 | 0.48 | 1.96 | 3.33 | 0.10 | 5.61 |

$E_{avg}$ = Illuminance
$E_{avg/min}$ = Illuminance Uniformity
$L_{avg}$ = Luminance
$L_{avg/min}$ = Luminance Uniformity
$L_{max/min}$ = Luminance Uniformity
$Lv_{max}/Lp_{avg}$ = Veiling Luminance
STV = Contrast
Spacing = 200', Mounting Height = 40', −5' Overhang, Total Road Width = 24', LLF = 0.72
Values of E in FC, L in cd/$m^2$
All systems are Full Cutoff As a result of the present invention, a positive contrast roadway lighting system is provided having an asymmetric light distribution providing improved visibility with virtually no glare. The system meets IESNA RP-8-2000 and AASHTO freeway lighting requirements and also meets a Mounting Height ratio of 5:1 or better for luminaire pole spacing. The system of the present invention improves visibility with positive contrast and reduces skyglow both directly, by the luminaire achieving full cutoff, and indirectly, by reducing amount of light between 0-60° vertical. Also, the roadway lighting system of the present invention saves energy by providing better lamp utilization and light output at higher vertical angles.

Moreover, the low profile, elliptically shaped housing of the luminaire of the present invention results in low EPA (effective projected area) and the optics can be adjusted for setback compensation and the main aiming beam can be adjustable. The housing can further be provided with positive latching for secure closure and a 4-bolt fitter clamp with positive stop and can be easily removable with adaptive hinging and a capture screw. The luminaire can further be provided with leveling means to provide adjustment of between ±7.5° and is gasketted to meet an IP66 rating for dust and watertight operation.

Although illustrative embodiments of the present invention have been described herein with reference to the accompanying drawings, it is to be understood that the invention is not limited to those precise embodiments, and that various other changes and modifications may be effected by one skilled in the art without departing from the scope or spirit of the invention.

What is claimed is:

1. A luminaire comprising:

a reflector having a center of symmetry and including a plurality of curved reflective horizontal bands arranged coaxially in decreasing radial size order along a central z-axis beginning at a central x-y plane, said central z-axis intersecting said central x-y plane to define said center of symmetry, each of said horizontal bands having a planar width and being individually angularly oriented to reflect light at a respective preselected angle, wherein said horizontal bands define a series of flat surfaces; and a lamp supported within said reflector, said lamp being offset from said reflector center of symmetry in all axes, whereby light emitted from said lamp is reflected by said reflector in an asymmetric pattern, wherein said lamp comprises a tube having a longitudinal axis parallel with said central x-y plane, whereby said lamp tube is horizontally oriented within said reflector.

2. A luminaire as defined in claim 1, wherein said reflector comprises circular curved bands forming a spherical reflector.

3. A luminaire as defined in claim 2, wherein said reflector has a maximum diameter at said central x-y plane and a height along said central z-axis from said central x-y plane to a reflective top surface, said lamp tube having a center defined by the mid-point of the tube along said longitudinal axis, said lamp center being offset from said center of symmetry in an x-direction a distance of about one-third (⅓) said maximum diameter.

4. A luminaire as defined in claim 3, wherein said lamp center is further offset from said center of symmetry in a y-direction a distance of about one-twentieth (1/20) said maximum diameter and in a z-direction a distance of about one-eighth (⅛) said height.

5. A luminaire as defined in claim 1, wherein said reflector comprises elliptical curved bands forming an elliptical reflector.

6. A luminaire as defined in claim 5, wherein said reflector has a maximum minor axis dimension in an x-direction and a maximum major axis dimension in a y-direction at said central x-y plane and a height along said central z-axis from said central x-y plane to a reflective top surface, said lamp tube having a center defined by the mid-point of the tube along said longitudinal axis, said lamp center being offset from said center of symmetry in said x-direction a distance of about one-fourth (¼) said maximum minor axis dimension.

7. A luminaire as defined in claim 6, wherein said lamp center is further offset from said center of symmetry in said y-direction a distance of about one-fifteenth (1/15) said maximum major axis dimension and in a z-direction a distance of about one-eighth (⅛) said height.

8. A luminaire as defined in claim 1, wherein said reflector includes a circumferential edge defining a reflector opening plane, said reflector opening plane being disposed at an angle with respect to said central x-y plane.

9. A luminaire as defined in claim 1, wherein said reflector includes an opening and said luminaire further comprises a planar lens plate disposed adjacent said reflector opening, said planar lens plate being disposed at an angle with respect to said central x-y plane.

10. A luminaire as defined in claim 1, wherein said reflector comprises oval curved bands forming an ovoid reflector.

11. A luminaire as defined in claim 10, wherein said ovoid reflector has a plane of bi-symmetry and said lamp center is offset from said reflector center of bi-symmetry, whereby light emitted from said lamp is reflected by said reflector in an asymmetric pattern.

12. A luminaire as defined in claim 11, wherein each of said oval reflective bands comprises four elliptically shaped arc segments.

13. A luminaire as defined in claim 12, wherein said arc segments comprise a first arc segment defined by a minor axis in the x-direction and a major axis in the y-direction and a second arc segment defined by a minor axis in the x-direction and a major axis in the y-direction, wherein the minor axes for the first and second arc segments are equal, and wherein the major axis for the first arc segment is greater than the major axis of the second arc segment.

14. A luminaire as defined in claim 13, wherein said arc segments are truncated in the x-direction so that said reflective band has a width less than said minor axes.

15. A luminaire as defined in claim 1, wherein said reflector includes an opening and said optical assembly further comprises a reflector hood disposed at said reflector opening for directing light in said asymmetric pattern.

16. A luminaire as defined in claim 15, wherein said reflector hood restricts light emitted from said lamp at eighty degrees (80°) vertical and above on a direction of traffic side of the optical assembly and at fifty degrees (50°) vertical and above on an opposite side of the optical assembly.

17. A luminaire as defined in claim 15, wherein said reflector hood comprises a ring portion and a bill portion extending from said ring portion, said ring portion having a size and shape adapted to fit on said opening of said reflector and said bill portion extending outwardly therefrom in a radial direction and being angled downward in the axial direction.

18. A luminaire as defined in claim 17, wherein said reflector includes a circumferential edge defining a plane of said reflector opening, said reflector opening plane being disposed at an angle with respect to said central x-y plane, and wherein said bill portion of said hood includes a circumferential edge forming a hood opening defined by a hood opening plane, said hood opening plane being parallel with said central x-y plane.

19. A luminaire as defined in claim 15, wherein said reflector hood is adjustable with respect to said reflector for directing light in a desired asymmetric pattern.

20. A luminaire as defined in claim 1, wherein said respective preselected angles range from thirteen degrees (13°) to one hundred two degrees (102°) with respect to said central x-y plane.

21. A luminaire as defined in claim 1, wherein each horizontal band comprises a plurality of rectangular shaped flat reflective facets connected end to end.

22. A luminaire comprising:

an ovoid reflector having a plane of bi-symmetry and including a plurality of oval curved reflective horizontal bands arranged coaxially in decreasing radial size order along a central z-axis beginning at a central x-y plane, said central z-axis intersecting said central x-y plane to define said center of symmetry, each of said horizontal bands having a width and being individually angularly oriented to reflect light at a respective preselected angle; and a lamp supported within said reflector, said lamp being offset from said plane of bi-symmetry of said reflector in all axes, whereby light emitted from said lamp is reflected by said reflector in an asymmetric pattern.

23. A luminaire as defined in claim 22, wherein each of said oval reflective bands comprises four elliptically shaped arc segments.

24. A luminaire as defined in claim 23, wherein said arc segments comprise a first arc segment defined by a minor axis in the x-direction and a major axis in the y-direction and a second arc segment defined by a minor axis in the x-direction and a major axis in the y-direction, wherein the minor axes for the first and second arc segments are equal, and wherein the major axis for the first arc segment is greater than the major axis of the second arc segment.

25. A luminaire as defined in claim 24, wherein said arc segments are truncated in the x-direction so that said reflective band has a width less than said minor axes.

26. A luminaire as defined in claim 22, wherein said lamp comprises a tube having a longitudinal axis parallel with said central x-y plane, whereby said lamp tube is horizontally oriented within said reflector.

* * * * *